US006353935B1

(12) United States Patent
Antonini

(10) Patent No.: US 6,353,935 B1
(45) Date of Patent: Mar. 12, 2002

(54) ADAPTED TENNIS SPORTSWEAR

(76) Inventor: Emanuele Antonini, Castel Regina + Castel B 41, avenue du Mont Alban, 06300 Nice (FR)

( * ) Notice: Subject to any disclaimer, the term of this patent is extended or adjusted under 35 U.S.C. 154(b) by 0 days.

(21) Appl. No.: 09/762,390

(22) PCT Filed: Aug. 7, 1998

(86) PCT No.: PCT/FR98/01766

§ 371 Date: Feb. 7, 2001

§ 102(e) Date: Feb. 7, 2001

(87) PCT Pub. No.: WO00/07471

PCT Pub. Date: Feb. 17, 2000

(51) Int. Cl.[7] ..... A41D 27/20
(52) U.S. Cl. ..... 2/115
(58) Field of Search ..... 2/115, 117, 106, 2/108, 109, 111, 113

(56) References Cited

U.S. PATENT DOCUMENTS 1,056,604 A * 3/1913 Stokes
1,302,108 A * 4/1919 Wetzel
1,459,747 A * 6/1923 Redmond
3,000,012 A * 9/1961 Neil ..... 2/94
4,100,622 A * 7/1978 Juelg, Jr. ..... 2/115
4,458,365 A * 7/1984 Wood ..... 2/104
4,663,782 A * 5/1987 Knox et al. ..... 2/104
5,090,060 A * 2/1992 Gates ..... 2/115
5,234,214 A * 8/1993 Sexton et al. ..... 273/29 R

* cited by examiner

*Primary Examiner*—John J. Calvert
*Assistant Examiner*—Alissa L. Hoey
(74) *Attorney, Agent, or Firm*—Young & Thompson

(57) ABSTRACT

The invention relates to a device permitting taking tennis balls from shorts despite the tennis shirt being out, and this without interfering with the player. It is constituted by a system of male (1,1') and female (2,2') snap members which, when snapped together, leave a free space (4), thanks to cutouts (3*f*,3*f'*,3*d*,3*d'*), so that the player can take balls from the pockets of his shorts (5). The device according to the invention is particularly adapted for taking out tennis balls.

6 Claims, 2 Drawing Sheets

ADAPTED TENNIS SPORTSWEAR

BACKGROUND OF THE INVENTION

The present invention relates to a device to permit a tennis player easily to take balls from the pockets of his shorts.

Taking balls out is conventionally carried out of course with the help of a hand. Given that the tennis shirt is often worn outside the shorts, the player is impeded in his movement for taking out the balls.

The result of a preliminary search of French patent 970648900 of May 16, 1997, discloses the existence of three U.S. patents but which do not have the same object as that of the present application:

U.S. Pat. No. 4,458,365 of Jul. 7, 1984 discloses a nursing blouse,

U.S. Pat. No. 4,663,782 of May 12, 1987 discloses a nursing blouse,

U.S. Pat. No. 5,234,214 of Aug. 10, 1993 discloses a tennis ball holder.

Certain tennis shirts have a region recessed by the manufacturer so as to avoid this problem encountered by players in training and at matches. This process does not eliminate the indicated drawbacks in use.

SUMMARY OF THE INVENTION

The device according to the invention permits overcoming this drawback. It thus comprises according to a first characteristic, a system of snaps as well as cutouts in the tennis shirt adapted to facilitate taking out balls. The male snap members are located in the middle of the lower end of the seams of the shirt, on both sides, and the female snap members above these latter, at a distance such that upon snapping, the passage of the hand of the player is easy, through the space exposed. The cutouts are a triangular shape and four in number, one of each side of the two male snap members. Thus, when the players snap the male and female members together, and thanks to the cutouts, access to the pockets of the shorts is given.

According to particular embodiments:

The visible portion, when snapping is effected, can be used as an advertising support.

The snap system can be replaced by strips of Velcro (trademark for hook and eye strips)

The shapes of the triangular cutouts can be modified to be oblique

The invention can serve as well for righthanded people as for lefthanded people because the device is repeated on the two sides of the tennis shirt.

The accompanying drawings show the invention:

DESCRIPTION OF THE PREFERRED EMBODIMENTS

Figure 1:
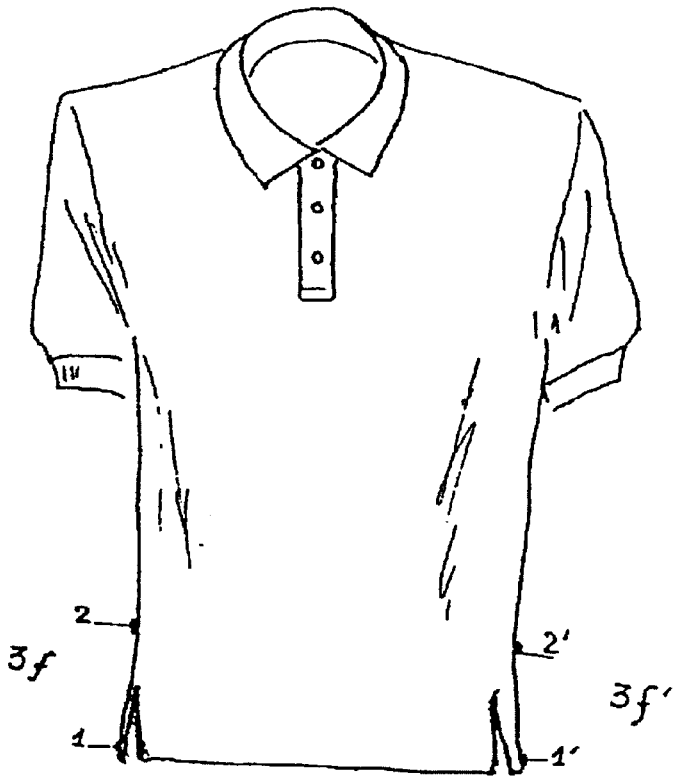
FIG. 1 is a front view of the device of the invention
Figure 2:
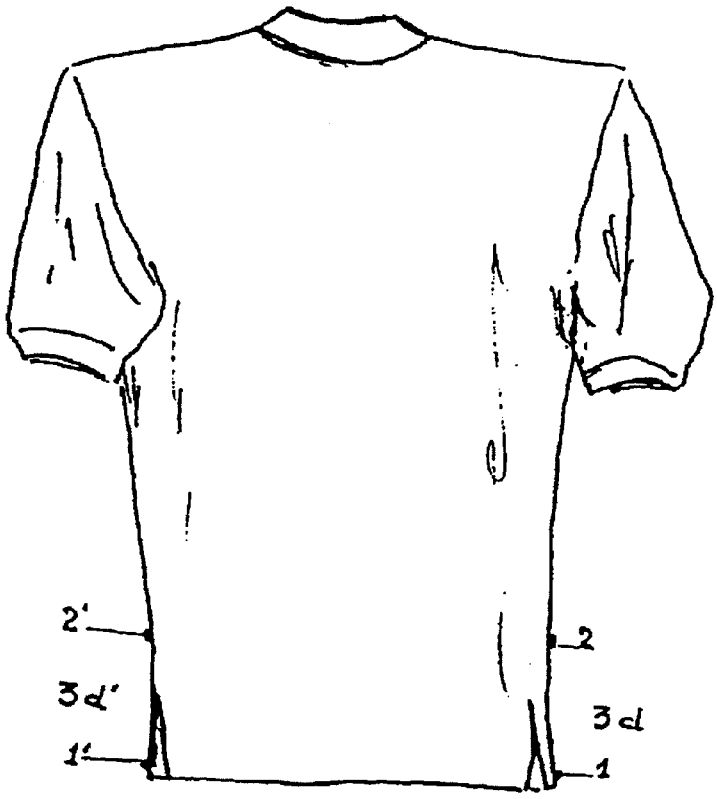
FIG. 2 is a rear view of the device of the invention
Figure 3:
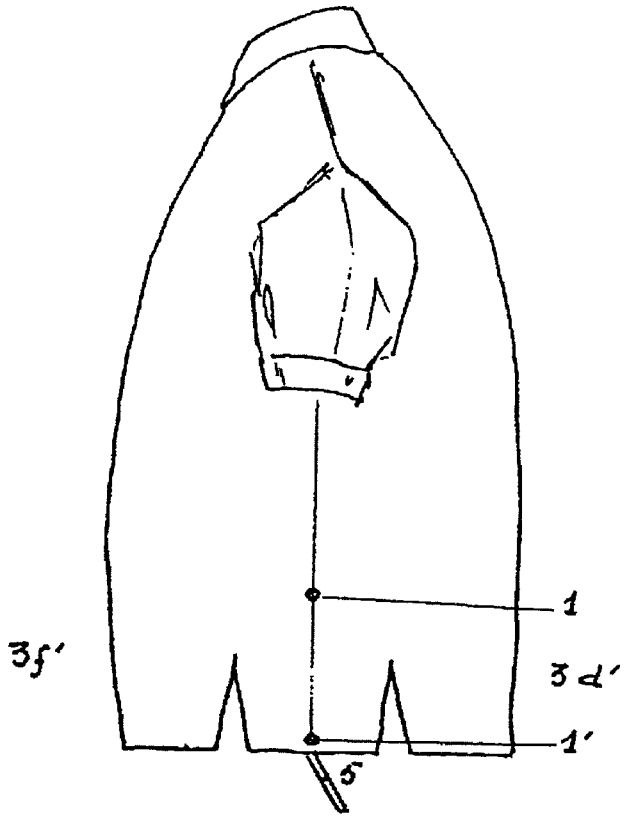
FIG. 3 is a side view of the device of the invention
Figure 4:
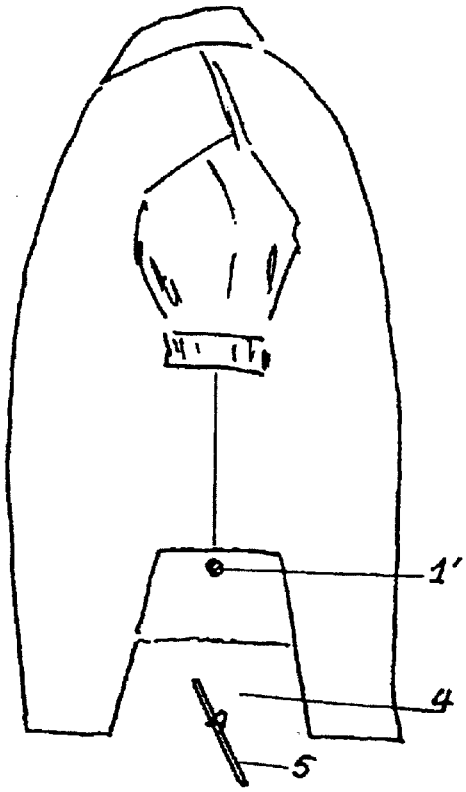
FIG. 4 is a side view, the device of the invention being in use.

Referring to these drawings, the device comprises two male snap members (1,1'), two female snap members (2,2'), and four cutouts (3*f*,3*f'*,3*d*,3*d'*).

When the male snap members (1,1') snap onto the female snap members (2,2') and thanks to the cutouts 3*f*,3*f'*,3*d*,3*d'*), the freed space (4) thus facilitates taking balls from the pocket of the shorts (5).

The distance between the two male and female snap members (1 and 2, 1' and 2') is such that the freed portion (4) leaves a very easy passage for the hand into the pocket (5).

By way of non-limiting example, the cutouts of triangular shape (3*f*,3*f'*,3*d*,3*d'*) will have lengths of five centimeters at the base and heights of fifteen centimeters. Thus, the distance which will separate the male (1,1') and female (2,2') snap members will be thirty centimeters.

The device according to the invention is particularly suitable to facilitate taking out tennis balls.

What is claimed is:

1. A tennis shirt comprising:

two pairs of cutouts, each said pair of cutouts defining a flap therebetween that is located at a lower portion of a respective side of a tennis shirt, each of said flaps being a first trapezoid with a shorter parallel side at a bottom edge of the tennis shirt and a longer parallel side above said shorter parallel side; and two fasteners, each of said fasteners having a first fastener part on a respective said flap adjacent to said shorter parallel side and a second fastener part on a respective side of the tennis shirt above said longer parallel side, said fastener securing said flap in an inverted position with said shorter side above said longer side.

2. The tennis shirt of claim 1, wherein said flap and a freed space between said cutouts that remains when said flap is in said inverted position define a second trapezoid larger than said first trapezoid, said second trapezoid having non-parallel sides that are defined by said cutouts and non-parallel sides of said first trapezoid and that are linear and continuous.

3. The tennis shirt of claim 1, wherein said fastener is one of a snap and a hook and loop fastener.

4. The tennis shirt of claim 1, wherein said cutouts have a height of 15 cm.

5. The tennis shirt of claim 4, wherein said first and second fastener parts are separated by 30 cm.

6. The tennis shirt of claim 1, wherein said first and second fastener parts are on a seam of the tennis shirt.

* * * * *